US007770252B2

(12) United States Patent
Errichiello et al.

(10) Patent No.: US 7,770,252 B2
(45) Date of Patent: Aug. 10, 2010

(54) MULTI-ADJUSTABLE PAINT APPLICATOR

(76) Inventors: Dominic R. Errichiello, 24 E. Thorndale Ave., Roselle, IL (US) 60172; Jeffrey L. Franklin, 45 Garfield, Oswego, IL (US) 60543

( * ) Notice: Subject to any disclaimer, the term of this patent is extended or adjusted under 35 U.S.C. 154(b) by 944 days.

(21) Appl. No.: 11/412,627

(22) Filed: Apr. 27, 2006

(65) Prior Publication Data

US 2007/0251041 A1 Nov. 1, 2007

(51) Int. Cl.
*A46B 7/02* (2006.01)

(52) U.S. Cl. ..... 15/172; 15/144.1; 15/144.2

(58) Field of Classification Search ..... 15/144.1, 15/144.2, 172, 230.11; 403/53
See application file for complete search history.

(56) References Cited

U.S. PATENT DOCUMENTS 3,273,192 A * 9/1966 Mazzella ..... 15/230.11
3,413,043 A * 11/1968 Bertolina ..... 403/393
5,207,755 A * 5/1993 Ampian ..... 15/230.11
5,502,859 A * 4/1996 Kim ..... 15/144.1
7,581,275 B2 * 9/2009 Rekart ..... 15/160
2007/0157406 A1 * 7/2007 Kim ..... 15/172

* cited by examiner

*Primary Examiner*—Dung Van Nguyen
(74) *Attorney, Agent, or Firm*—McDermott Will & Emery LLP

(57) ABSTRACT

The invention is directed to a multi-adjustable paint applicator assembly including an elongated handle with a first adjustment assembly that provides angular movement of an upper handle portion with respect to a lower handle portion. A base is rotatably connected to the handle by a second adjustment assembly that provides rotational movement of the base with respect to the handle. The base also has an upper portion with a receiver that slidingly engages a projection extending from a paint applicator. The paint applicator may be a paint brush, roller or pad with an applicator surface. The first and second adjustment assemblies each include a fastener and an arrangement of mating members that intermesh with another arrangement of mating members, wherein the fastener provides tension between the arrangements to releasably secure the angular or rotational position.

16 Claims, 7 Drawing Sheets

MULTI-ADJUSTABLE PAINT APPLICATOR

CROSS-REFERENCE TO RELATED APPLICATIONS

Not Applicable.

FEDERALLY SPONSORED RESEARCH OR DEVELOPMENT

Not Applicable.

TECHNICAL FIELD

The invention relates to a multi-adjustable paint applicator assembly that is capable of receiving different sized applicators, such as brushes and rollers, in an interchangeable manner. More specifically, the paint applicator assembly includes a first adjustment assembly that provides angular movement and a second adjustment assembly that provides rotational movement, each depending upon the configuration of the surface to be painted.

BACKGROUND OF THE INVENTION

Paint brushes, including adjustable versions, are well known in the art. While such paint brushes and paint brush holders provide a number of beneficial features, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention is directed to a multi-adjustable paint applicator assembly that interchangeably receives different sized paint applicators, such as brush assemblies, rollers and pads. The paint applicator assembly provides two degrees of freedom—angular movement of a handle and rotational movement of a base to which the paint applicator is coupled—that enable the painter to customize the positioning of the applicator based upon the configuration of the surface to be painted and the access to that surface. The multi-adjustable paint applicator assembly generally comprises the handle, a base, and a number of applicators, for example a brush, a roller and a pad, that can be selectively used and interchanged.

According to one aspect of the invention, the elongated handle has a lower portion, an upper portion and a first or angular adjustment assembly positioned between the upper and lower portions. The adjustment assembly provides angular movement of the upper portion with respect to the lower portion. The first adjustment assembly includes a fastener and a first arrangement of mating members, such as ribs, that intermesh with a second arrangement of mating members. The fastener provides tension between the first and second arrangements to releasably secure the angular position of the first and second handle portions.

According to another aspect of the invention, the base is rotatably connected to the upper portion of the handle by a second adjustment assembly located at a lower portion of the base. The second adjustment assembly provides rotational movement of the base with respect to the handle. The second adjustment assembly includes a fastener and a third arrangement of mating members that intermesh with a fourth arrangement of mating members. The fastener provides tension between the third and fourth arrangements to releasably secure the rotational position. The base also has an upper portion with an inwardly directed receiver that receives a projection of the paint applicator. Both the base and the paint applicator are capable of rotational movement by the second adjustment assembly.

According to yet another aspect of the invention, the paint applicator may be a brush assembly, a roller assembly and/or a pad assembly. The brush assembly has an array of bristles extending from a housing and a projection also extends from the housing. The projection is slidingly received by the receiver of the base to removably connect the brush assembly to the base. Since the paint applicator assembly of the invention has interchangeable capabilities, a second brush assembly with a larger or smaller bristle array can be operably connected to the base instead of the smaller first brush assembly. The roller assembly and the pad assembly each have a projection that is slidingly received by the receiver of the base in a press fit relationship to provide the interchangeable capabilities.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
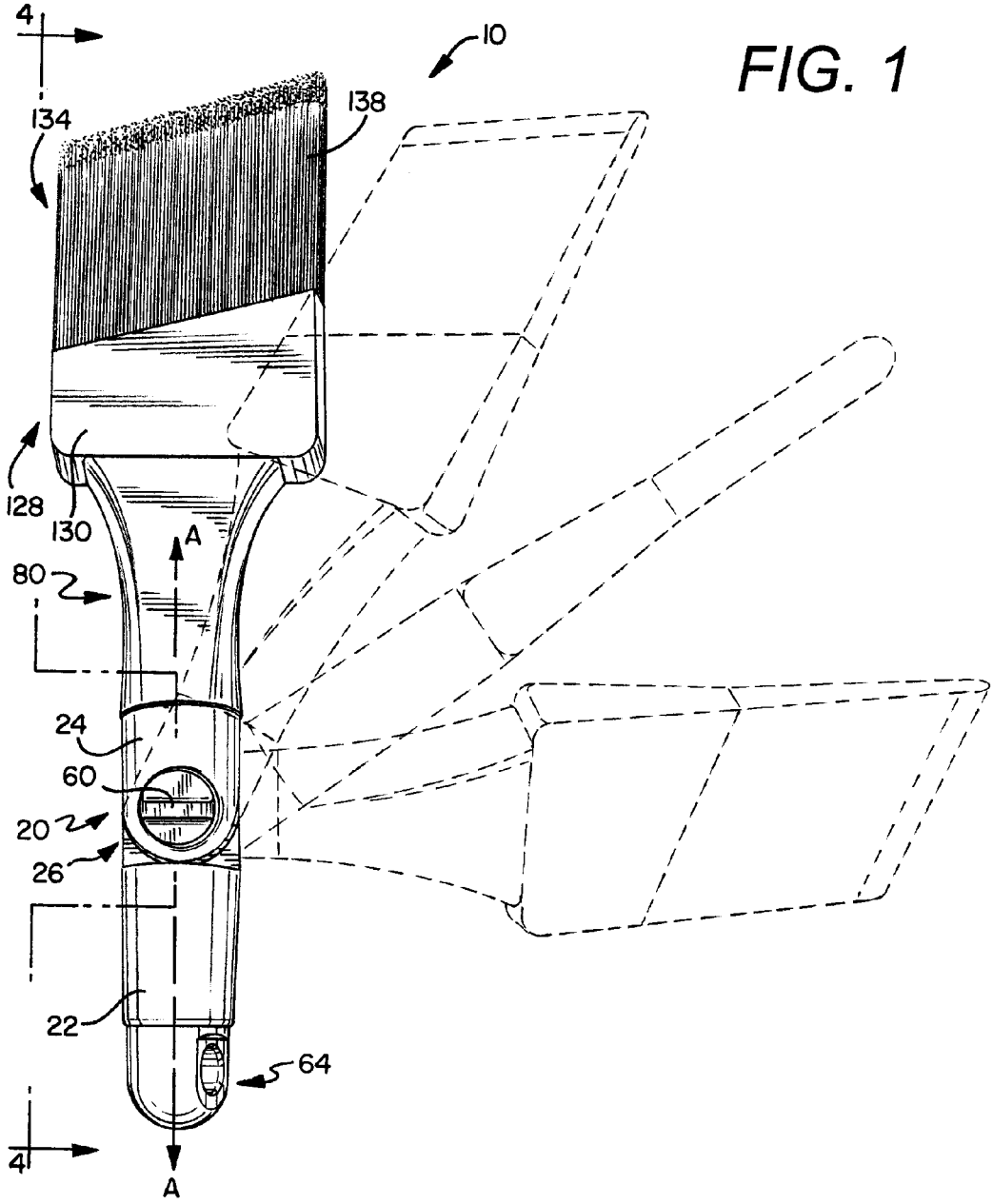
FIG. 1 is a perspective view of the multi-adjustable paint applicator assembly of the invention, showing the applicator assembly in various stages of angular position and rotation.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-7 depict a multi-adjustable paint applicator assembly 10. The multi-adjustable paint applicator 10 provides an ergonomic painting system that interchangeably receives different sized brush assemblies and rollers. As shown in FIGS. 1-2A-D, the paint applicator 10 provides two degrees of freedom—angular movement of a handle 20 and rotational movement of a base 80—that enable the painter to customize the positioning of the applicator 10 based upon the configuration of the surface to be painted and the access to that surface. For example, if the surface is an overhead horizontal trim piece, such as crown molding, the paint applicator 10 can be angularly and/or rotatably adjusted to ensure proper positioning and to facilitate even application of the paint to the trim piece. In addition, the paint applicator 10 accepts a number of accessories, such as a longer handle and an adaptor for an extension pole, to increase the versatility of the paint applicator 10. The multi-adjustable paint applicator 10 generally comprises the handle 20, the base 80, and a paint applicator 128, such as a brush assembly 130 or a roller assembly 150.

Figure 3:
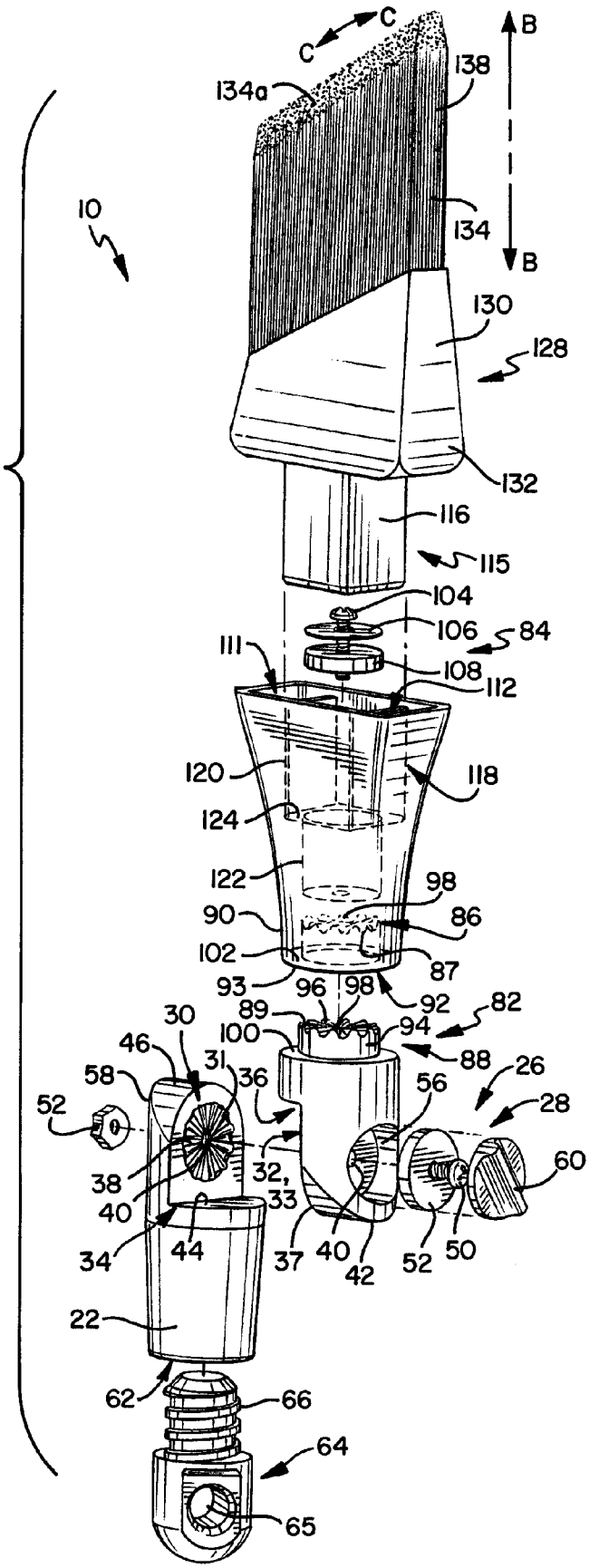
FIG. 3 is an exploded perspective view of the multi-adjustable paint applicator assembly.

Referring to the Figures, the handle 20 is an elongated structure having a lower portion 22, an upper portion 24 and a first adjustment assembly 26 positioned between the upper and lower portions 22, 24. The lower and upper portions 22, 24 combine to provide the handle 20 with a generally cylindrical configuration that the painter grasps to use the paint applicator 10. The first adjustment assembly 26 provides the applicator 10 with a first degree of freedom, angular movement of the upper portion 24 with respect to the lower portion 22. As explained in greater detail below, the adjustment assembly 26 allows the painter to adjust the handle 20 such that the lower and upper portions 22, 24 define a first angle θ that ranges between 0 and 180 degrees, preferably 90 and 180 degrees. When the painter utilizes the adjustment assembly 26, the brush assembly 130 is angularly positioned to facilitate application of paint to the surface to be painted. Described in a different manner, the handle 20 has a longitudinal axis A-A, wherein the adjustment assembly 26 provides for angular movement of the upper portion 24 with respect to the longitudinal axis A-A. The first adjustment assembly 26 includes a fastener assembly 28 and a first arrangement or array 30 of mating members 31, that intermesh with a second arrangement or array 32 of mating members 33. The painter can apply a disengaging force to the upper and lower portions 22, 24 to separate the first and second arrays 30, 32 of mating members 31, 33, which allows for angular movement of the upper and lower portions 22, 24. As shown in FIG. 3, the lower portion 22 includes an internal recessed segment 34 with a substantially planar inner wall 35, wherein the first arrangement 30 of mating members 31 is located on the inner wall 35. Similarly, the upper portion 24 includes an internal recessed segment 36 with a substantially planar inner wall 37, wherein the second arrangement 32 of mating members 33 is located on the inner wall 37. In one embodiment, the mating members 31, 33 are ribs 38 that extend radially outward from a central opening 40. Referring to FIG. 3, each rib 38 has a width that increases as the rib 38 extends radially outward from the central opening 40. Preferably, each rib 38 is raised from the inner wall 35, 37 and has a curvilinear exterior surface when viewed from the side. The upper portion 24 has a curvilinear bottom wall 42 that pivotally engages a substantially horizontal bottom wall 44 of the recessed segment 34 of the lower portion 22. Similarly, the lower portion 22 has a curvilinear top wall 46 that pivotally engages a substantially horizontal top wall 48 of the recessed segment 36 of the upper portion 24. Although ribs 38 are shown in the Figures, the mating members 31, 33 may be bumps or projections, such as hemispherical projections, that are lockingly received in a recess or opening, as well as other mating configurations. After the operator has made the necessary adjustment to reach the desired position for painting, the engagement between the projections and the recess provides securement for the first adjustment assembly 26.

The fastener assembly 28 provides tension between the first and second arrangements 30, 32 to releasably secure the angular position of the first and second handle portions 22, 24. The fastener assembly 28 includes an elongated fastener 50, such as a threaded screw, that extends through the central opening 40 in each of the arrangements 30, 32, an elastic compression member or washer 52, and a nut 54. The washer 52 is received within a recess 56 of the upper portion 24 and the nut 54 is received within a recess 58 of the lower portion 22. The washer 52 may be formed from elastomeric material, while the screw 50 and the nut 54 are preferably formed from metal. The fastener assembly 28 may also include a control knob 60 that is operably connected to the fastener 50 to adjust the tension between the components of the first adjustment assembly 26, primarily the mating members 31, 33. Preferably, the handle 10 is configured such that the fastener assembly 28 is internalized with only the control knob 60 extending outward for access by the painter. Although the screw 50 and the control knob 60 are shown as two distinct components, they may be combined as a single element of the fastener assembly 28. Once the lower and upper handle portions 22, 24 are assembled, the fastener 50 is oriented substantially perpendicular to the longitudinal axis A-A of the handle 20.

Figure 5:
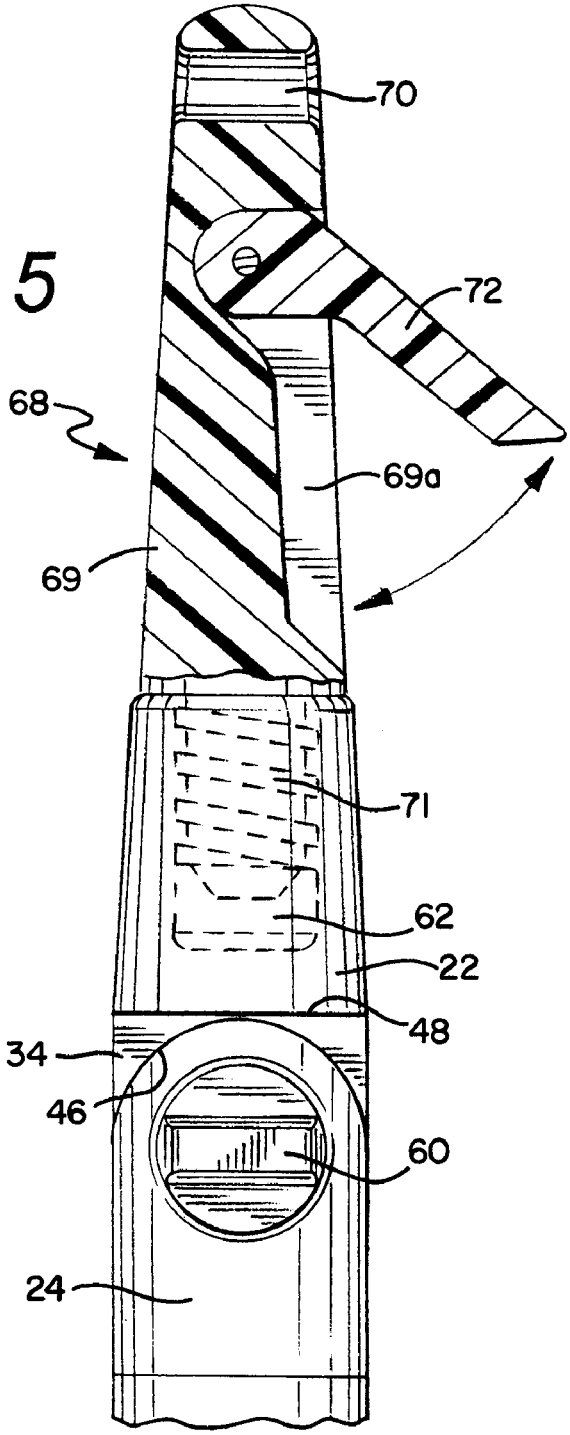
FIG. 5 is a partial cross-sectional view of the multi-adjustable paint applicator assembly, showing an elongated end cap with a pivotable finger.
Figure 6:
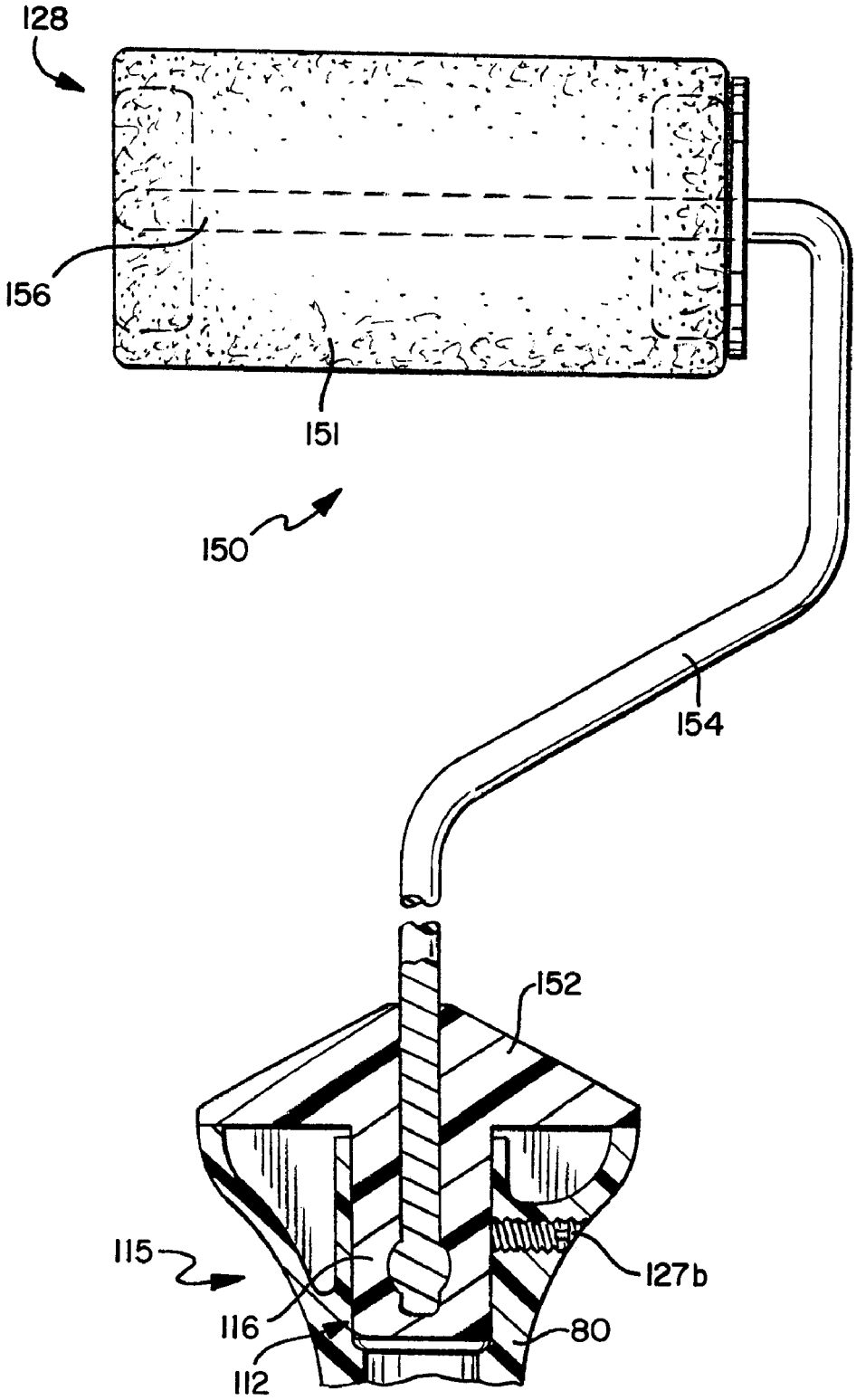
FIG. 6 is a perspective view of the multi-adjustable paint applicator assembly, showing a roller assembly connected to the applicator assembly; and, FIG. 7 is a perspective view of the multi-adjustable paint applicator assembly, showing an alternate rotary control wheel for a rotational adjustment assembly.
Figure 7:
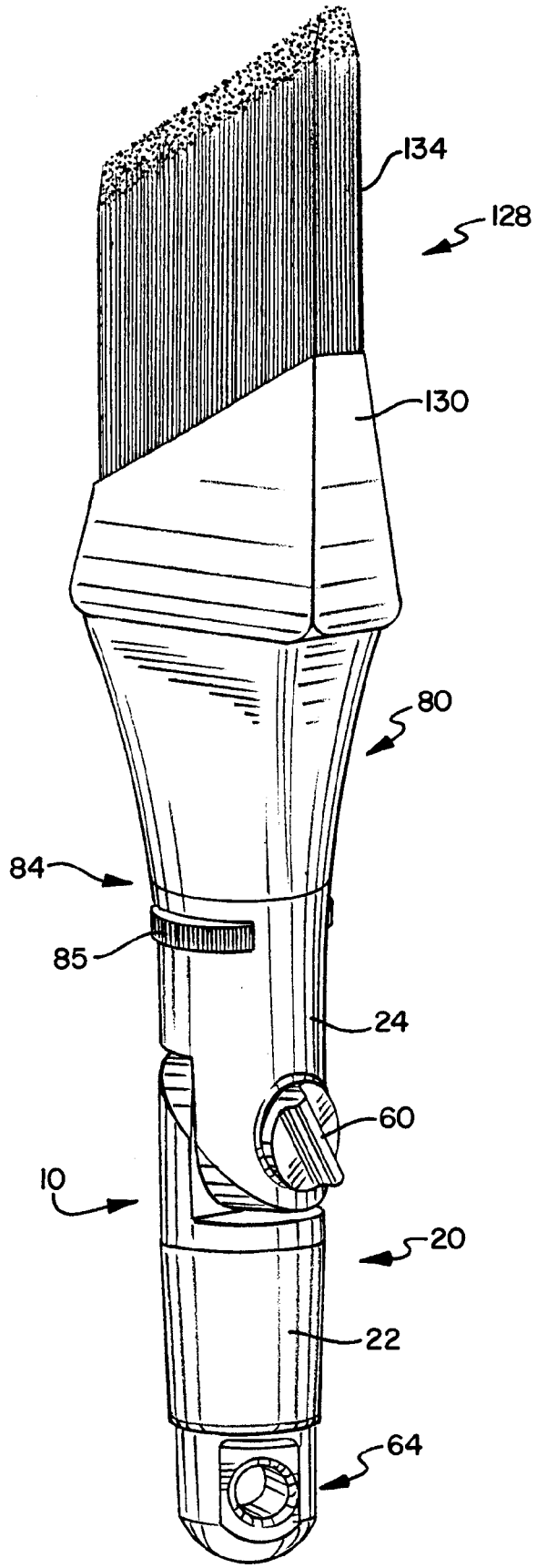

The lower portion 22 of the handle 20 includes a second receiver or opening 62 that is adapted to receive an end cap 64 with an aperture 65 that enables the paint applicator assembly 10 to be hung for drying purposes after use. The end cap 64 includes a threaded projection 66 that is received by internal threads of the second opening 62. An auxiliary hanger clip (not shown) provides the painter with means to hang the paint applicator 10 when not in use. The hanger clip generally includes a main body portion and opposed fingers that extend outward from the main body portion and that engage an extent of the handle 20. The main body portion is configured to securedly engage a structural element, such as a paint can, for support during periods of non-use of the paint applicator assembly 10. An alternate longer end cap 68 is shown in FIG. 5, wherein the end cap 68 includes an elongated central portion 69 between the aperture 70 and the threaded projection 71. Once connected to the handle 20, the longer alternate end cap 68 increases the overall length of the handle 20 to provide extra reach for the paint applicator 10. The end cap 68 also includes a pivotable finger 72 that is pivotable between a retracted position wherein the finger 72 is positioned within a recess 69*a* of the central portion 69, and a deployed position wherein the finger 72 engages a portion of a support surface to hang the paint applicator 10. For example, the finger 72 engages a lip of a paint can to hang the paint applicator 10 when not in use. The paint applicator assembly 10 also includes at least one adaptor (not shown) that is configured to join an extension member or pole (not shown) to the lower portion 22 of the handle 20. Like the end cap 64, the adaptor includes a threaded projection that is received by internal threads of the second receiver 62. Opposite the projection, the adaptor has a coupler element that is dimensioned to engage an end of the extension pole.

Figure 4:
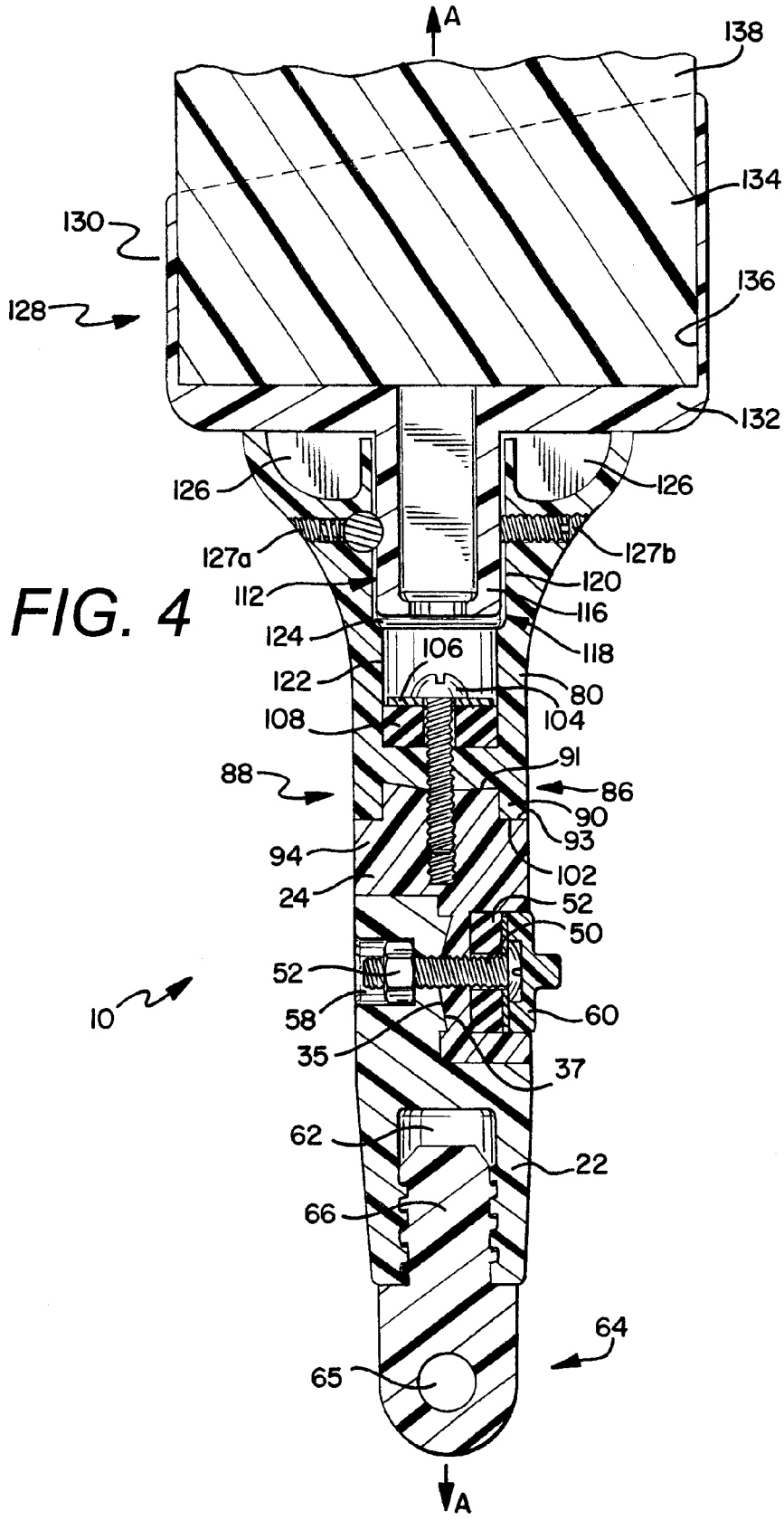
FIG. 4 is a cross-sectional view of the multi-adjustable paint applicator assembly, taken along line 4-4 of FIG. 1.

Referring to FIGS. 1, 3 and 4, the base 80 is an intermediate structure of the paint applicator assembly 10 that interchangeably receives the various paint applicators 128 and is rotatably connected to the handle 20 by a second adjustment assembly 82. The second adjustment assembly 82 provides the applicator 10 with a second degree of freedom: rotational movement of the base 80 and the connected brush assembly 130 with respect to the handle 20. As shown in FIGS. 1 and 2A-D, the second adjustment assembly 82 allows the painter to adjust the base 80 approximately 360 degrees such that the orientation of the paint applicator 128, such as the bristle edge of a brush assembly 130, corresponds to the orientation of the surface to be painted. Described in a different manner, the second adjustment assembly 82 provides for rotational movement of the brush assembly 130 with respect to the longitudinal axis A-A. The second adjustment assembly 82 includes a fastener assembly 84 and a third arrangement or array 86 of mating members 87 that intermesh with a fourth arrangement or array 88 of mating members 89. The painter can apply a disengaging force to the upper portion 22 and the base 80 to separate the third and fourth arrays 86, 88 of mating members 87, 89, which allows for rotational movement of the base 80 and the paint applicator 128. As shown in FIG. 4, a lower portion 90 of the base 80 includes a generally horizontal wall 91, wherein the third arrangement 86 of mating members 87 is located on or is formed in the horizontal wall 91. The horizontal wall 91 is recessed inward from an opening 92 of the lower base portion 90, whereby the third arrangement 86 is recessed from a lower edge 93 of the lower base portion 90. Turning to the fourth arrangement 88 of mating members 89, the upper handle portion 24 includes a stem 94 wherein the fourth arrangement 88 is located on or is formed in an upper wall of the stem 94. As shown in FIGS. 3 and 4, the third and fourth arrangements 86, 88 are oriented substantially perpendicular to the first and second rib arrangements 30, 32. In one embodiment, the mating members 87,89 are ribs 96 that extend radially outward from a central opening 98. Preferably, the ribs 96 are structured similar to the ribs 38 of the first and second arrangements 30, 32. The stem 94 extends from a substantially horizontal upper wall 100 of the upper handle portion 24, wherein the upper wall 100 slidingly engages an end wall 102 of the base 80 during rotation of the base 80. Once the base 80 is operably connected to the handle 20, the fourth mating member arrangement 88 extends into the opening 92 of the lower base portion 90 and past the lower edge 93. Consistent with that explained above, although ribs 96 are shown in the Figures, the mating members 87, 89 may comprise other geometric formations, including bumps or projections, such as hemispherical projections, that are lockingly received in a recess or opening.

The fastener assembly 84 provides tension between the third and fourth mating member arrangements 86, 88 to releasably secure the rotational position of the base 80 and the brush assembly relative to the handle 20. The fastener assembly 84 includes an elongated fastener 104, such as a threaded screw, that extends through the central opening 98 in each of the third and fourth arrangements 86, 88, a rigid washer 106, and an elastic compression member or washer 108. An upper portion 110 of the base 80 has a receiver 112 that extends inward from an upper end opening 114. The fastener assembly 84, including the screw 104 and the washers 106, 108, is inserted into the receiver 112, wherein the screw 104 is threaded through the central openings 98 to operably connect the third and fourth mating member arrangements 86, 88 and join the base 80 to the upper portion 24 of the handle 20. The washer 108 may be formed from elastomeric material, while the washer 106 and screw 104 is preferably formed from metal. Typically, washers 108 and 52 are identical components. Referring to FIG. 5, an alternate fastener assembly 84 may also include a rotary control knob 85 that is operably connected to the screw 104 to adjust the tension between the components of the second adjustment assembly 82. The rotary control knob or wheel 85 extends through a slot in either the lower base portion 90 or the upper handle portion 24, such that the painter can adjust the fastener assembly 84 without accessing the screw 104 through the receiver 112. After the base 80 and handle 20 are assembled via the second adjustment assembly 82, the screw 104 is substantially parallel to the longitudinal axis A-A of the handle 20, preferably aligned with the longitudinal axis A-A.

The base 80 includes a first engaging member 111 opposing the second adjustment assembly 82 that removably attaches or couples with a second engaging member 115 of the brush assembly 130. In the embodiment shown in FIG. 3, the first mating member 111 is the receiver 112 of the base 80, and the second mating member 115 is the elongated projection 116 that extends from the brush assembly 130. Accordingly, the receiver 112 is configured to slidingly receive the projection 116 in a press-fit relationship to removably couple the paint applicator 128, in this configuration the brush assembly 130, to the base 80 and the handle 20. The receiver 112 includes an internal wall arrangement 118 having a first wall segment 120 and a second wall segment 122, wherein a width of the first wall segment 120 exceeds a width of the second wall segment 122. Due to the width disparity, a step or notch 124 is formed between the first wall segment 120 and the second wall segment 122. The notch 124 is adapted to restrict further movement of the brush assembly projection 116 during insertion into the receiver 112. A peripheral cavity 126 (see FIG. 4) is formed on each side of the receiver 112, wherein the base 80 has a curvilinear configuration with a downward taper. Preferably, the base 80 is formed by injection molding of plastic material. A releasable, spring-loaded detent 127*a* or a set screw 127*b* may be utilized to securedly retain the projection 116 within the receiver 112.

The multi-adjustable paint applicator assembly 10 can accept various paint applicators 128 in an interchangeable manner. Referring to the Figures, a first brush assembly 130 has a housing 132 with an applicator member 133, such as a bristle array 134, that extend from a cavity 136 of the housing 132. As mentioned above, the brush assembly 130 includes the projection 116, one type of second engaging member 115, that extends from the housing 132 and that is slidingly received by the receiver 112 to connect the brush assembly 130 with the base 80. Preferably, the projection 116 and the receiver 112 are dimensioned such that once connected, the projection 116 and the receiver 112 are in a press-fit relationship. The housing 132 may includes a name plate (not shown) for receiving indicia regarding the product name, supplier or manufacturer. The housing 132 has a width that generally exceeds a width of the base 80 at its upper end 114. The bristle array 134 comprises a plurality of bristles 138 that are secured within the cavity 136 and that are used to apply the paint to the surface to be painted. The bristle array 134 can have an angled top edge 134*a* (see FIG. 3), such as that used in painting angled surfaces or trim work, a horizontal top edge, or some other shape. The bristle array 134 has a major axis B-B and a minor axis C-C. As shown in FIG. 3, the major axis B-B corresponds to a length of the array 134, and the minor axis C-C corresponds to a width of the array 134. The orientation of the major and minor axes B-B, C-C varies with the angular position of the housing 132 and the base 80 relative to the longitudinal handle axis A-A, as provided by the second adjustment assembly 82.

Since the multi-adjustable paint applicator assembly 10 has the ability to interchangeably receive brush assemblies, a second brush assembly (not shown) includes a projection that extends from a housing. The projection of the second brush assembly is similarly dimensioned to the projection of the first brush assembly 130, wherein the projection is slidingly received by the receiver 112 for connection of the second brush assembly with the base 80. Beyond its projection, the second brush assembly has configurations that differ from the first brush assembly 120. For example, the second brush assembly includes a larger bristle array which results from a greater number of bristles and the housing has a width that exceeds the width of the base 80 and the width of the first brush assembly. Therefore, when the second brush assembly is connected to the base 80, the housing extends beyond the upper edge 114 of the base 80.

The multi-adjustable paint applicator assembly 10 also includes a roller assembly 150 that can be operably connected to the base 80, instead of one of the brush assemblies 130. The roller assembly 150 enables the painter to apply paint with a tubular roller 151 that rotates as the roller assembly 150 is moved along the surface to be painted. The roller assembly comprises a housing 152, an elongated arm 154, a rotatable support 156 for the roller, and the second engaging member 115, such as the projection 116 that extends from the housing 142. The projection 116 of the roller assembly 150 is similarly dimensioned to the projection 116 of the first and second brush assemblies 130, 140, wherein the projection 116 is slidingly received by the receiver 112 for connection of the roller assembly 150 with the base 80. Although not shown, the roller assembly 150 includes a rotation mechanism for the support 156 that engages the roller 151. Yet another paint applicator 128 is a pad (not shown) that comprises an elongated handle, a support plate, and a paint pad that is generally soft and removably supported by the plate. Typically, the paint pad has a square or rectangular configuration. Like the other paint applicators 128 explained above, the pad handle has a projection that his received by the receiver 112 for connection to the base 80 and the handle 20. Accordingly, there is interchangeability between the base 80 and the paint applicators 128—the first brush assembly 130, the second brush assembly, the roller assembly 150 and the pad.

Figure 2A:
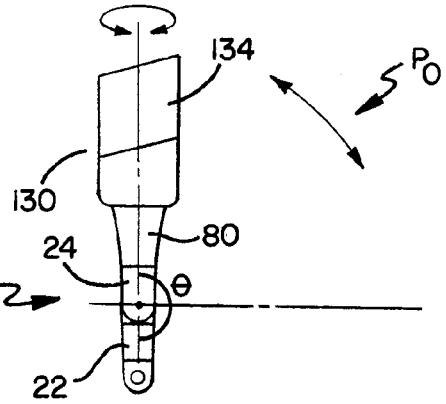
FIG. 2 A-D are schematic views of the multi-adjustable paint applicator assembly, showing angular and rotational movement.

In operation, the two degrees of freedom (i.e., angular and rotational) provided by the multi-adjustable paint applicator assembly 10 enable the painter to customize the positioning of the applicator assembly 10 based upon the configuration of the surface to be painted and the access to that surface. FIGS. 2A-D illustrate the positional movement of the applicator assembly 10. Referring to FIG. 2A, in an initial position $P_0$, the first and second handle portions 22, 24 are aligned which results in a linear handle 20 configuration. As a result, the first angle θ is substantially 180 degrees. From the initial position $P_0$, the applicator assembly 10 can be angularly displaced with the first adjustment assembly 28 and/or or rotated with the second adjustment assembly 82.

Figure 2B:
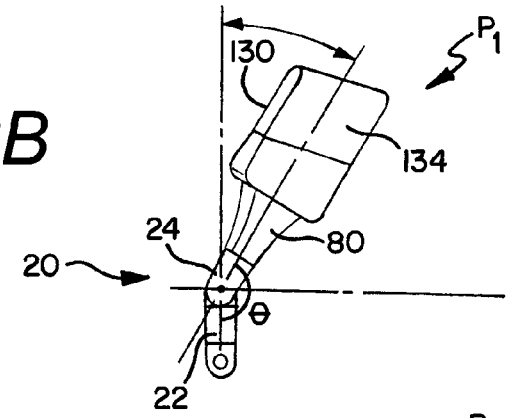

In a first use position $P_1$ of FIG. 2B, the first adjustment assembly 28 and the second adjustment assembly 82 have been actuated such that the first and second handle portions 22, 24 are angularly positioned and the bristle array 134 is suitably oriented based upon the configuration and/or inclination of the surface to be painted. The angular component of the first use position $P_1$ can be arrived at in one of two ways, as explained below. Preferably, both the first and second adjustment assemblies are provided with the appropriate amount of tension such that they remain in a fixed position until a sufficient amount of pressure, such as a disengaging force, is applied by the user to either of the adjustment assemblies such that the adjustment assemblies can then be manipulated and subsequently released in a different orientation. The tension in each of the adjustment assemblies is a result of adjusting the control knob to tighten (i.e., apply additional tension) and loosen (i.e., release tension) the connection between the mating members of each respective adjustment assembly. Typically, the tension in each adjustment assembly is initially set utilizing the control knob for each adjustment assembly, and then it is maintained at that tension unless some need arises to adjust the tension, such as wear of the components. Thus, in a preferred embodiment the positioning of each adjustment assembly can be readjusted without having to adjust the tension in each adjustment assembly.

Following the application of the disengaging force and manipulation of the components to adjust the relationship of the mating members of the adjustment assemblies, the disengaging force is released at some point (i.e., the desired position) and the adjustment assemblies remain in that desired position due to the tension in the adjustment assemblies. Accordingly, to adjust the assembly 10 the painter applies the disengaging force to handle 20 to allow for movement between the upper and lower portions 22, 24, including the first and second arrangements 30, 32 of mating members 31, 33, which allows for angular movement of the upper and lower portions 22, 24. The disengaging force compresses the elastomeric washer 52 a sufficient amount which provides for decreasing the retention force between the mating members 31, 33, thereby allowing the painter to quickly and easily manipulate the handle 20 to reach an angle θ, which as shown is approximately 150 degrees. Described in a different manner, by applying a sufficient force to compress the washer 52, the first and second mating member arrangements 30, 32 can be disengaged from a fixed position to allow for relative movement which provides the angular movement of the upper and lower handle portions 22, 24. Once the desired position is reached, the painter removes the disengaging force which causes the mating members 31, 33 to fixedly intermesh to secure the handle 20 in the first use position $P_1$.

Alternatively, the painter utilizes the control knob 60 to release tension in the first adjustment assembly 26 to angularly position the first and second portions 22, 24 and define the first angle θ, which is approximately 150 degrees. Once sufficient tension is released, the first and second arrangements 30, 32 are separated a short distance such that the mating members 31, 33, for example the ribs 38, do not intermesh or interact to preclude angular movement.

The rotational component of the first use position $P_1$ can also be changed in one of two ways as explained above. Preferably, the painter applies another disengaging force to handle 20, to allow for movement between the base 80 and the paint applicator 128, including the third and fourth arrangements 86, 88 of mating members 87, 89 which allows for rotational movement of the base 80 and the paint applicator 128. This disengaging force compresses the elastomeric washer 108 sufficiently during decoupling of the mating members 87, 89 which in turns allows the painter to quickly and easily manipulate the base 80 and/or paint applicator 128 to the desired rotational position, which is approximately 45 degrees, without having to adjust the tension in the second adjustment assembly. Described in a different manner, by applying a sufficient separation force to compress the washer 108, the first and second mating member arrangements 86, 88 disengage from their fixed positions to allow for the rotational movement. Once the desired position is reached, the painter releases the disengaging force which causes the mating members 87, 89 to fixedly intermesh and the second adjustment assembly 82 to secure the base 80 and the paint applicator 128 in the first use position $P_1$. Alternatively, as explained above, the painter releases the tension in the second adjustment assembly 82 by loosening the fastener 104. Once sufficient tension is released, the third and fourth arrangements 86, 88 are separated such that the multi-positional members 87, 89, for example the ribs 96, do not fixedly intermesh or interact to preclude rotational movement. After the desired rotational position is reached, the painter tightens the fastener 102 to provide sufficient tension to the second adjustment assembly 82 to secure the handle 20. The first means for adjusting each adjustment assembly is preferred, however, because under this method once the tension in each adjustment assembly is set, no further adjustment of the control knob is required to allow the different components of the handle to be angularly and/or rotationally adjusted.

Figure 2C:
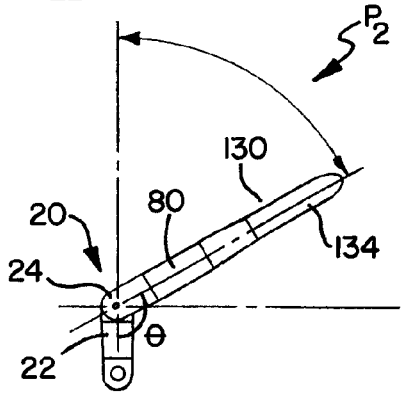
Figure 2D:
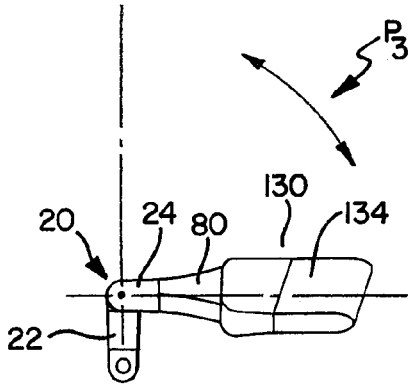

In a second use position $P_2$ of FIG. 2C, the first adjustment assembly 28 and the second adjustment assembly 82 have been actuated such that the first and second handle portions 22, 24 are angularly positioned to define the first angle θ of approximately 120 degrees, and the base 80 and the bristle array 134 are rotated approximately 90 degrees such that the edge of the bristle array 134 is visible. Consistent with that explained in the foregoing paragraph, regarding both the preferred and alternate methods of enabling movement, the painter manipulates the first and second adjustment assemblies 28, 82 to secure the relative positions. In a third use position $P_3$ of FIG. 2D, the first adjustment assembly 28 and the second adjustment assembly 82 have been actuated such that the first and second handle portions 22, 24 are angularly positioned to define the first angle θ of approximately 90 degrees, and the base 80 and the bristle array 134 are rotated approximately 135 degrees (or 45 degrees more than that shown in the second position $P_2$). Consistent with that explained in the foregoing paragraph, regarding both the preferred and alternate methods of enabling movement, the painter manipulates the first and second adjustment assemblies 28, 82 to secure the relative positions. Depending upon the amount of rotation provided by the second adjustment assembly 82, one of the major axis B-B or the minor axis C-C of the bristle array 134 will be aligned with the control knob 60 of the base 80, while the other of the major axis B-B or the minor axis C-C of the bristle array 134 will be misaligned with the control knob 60. It is understood that use of the first and second adjustment assemblies 26, 82 are not mutually exclusive. Thus, a painter can adjust the positioning of the paint applicator 10 by using either the first adjustment assembly 26 or the second adjustment assembly 82, or both.

In an alternate version of the paint applicator 10, the handle 20 includes the lower portion 22, the upper portion 24 and the base 80. The first adjustment assembly 26 connects the lower portion 22 to the upper portion 24, while the second adjustment assembly 82 connects the upper portion 24 to the base 80. The first adjustment assembly 26 provides one of angular movement of the upper portion 24 with respect to the lower portion 22 and rotational movement of the upper portion 24 with respect to the lower portion 22. The second adjustment assembly 82 provides one of angular movement of the upper portion 24 with respect to the base 80 and rotational movement of the upper portion 24 with respect to the base 80. For example, the first adjustment assembly 26 provides angular movement of the upper portion 24 with respect to the lower portion 22 to define the first angle θ, and the second adjustment assembly 82 provides rotational movement of the upper portion 24 with respect to the base 80 and the longitudinal axis A-A. As another example, the first adjustment assembly 26 provides rotational movement of the upper portion 24 with respect to the lower portion 22 and the longitudinal axis A-A, and the second adjustment assembly 82 provides angular movement of between the upper portion 24 and the base 80 to define the first angle θ. Further, both the first and second adjustment assemblies allow for repositioning in any of a number of positions depending on the type of engagement between the mating members.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A multi-adjustable paint applicator assembly comprising:

an elongated handle having a lower portion, an upper portion and a first adjustment assembly positioned between the upper and lower portions, the handle further having a longitudinal axis A-A extending about a length of the handle, wherein the first adjustment assembly provides angular movement of the upper portion with respect to the lower portion, a base rotatably connected to the upper portion of the handle by a second adjustment assembly, wherein the second adjustment assembly provides rotational movement of the base with respect to the handle, the second adjustment assembly comprising a plurality of projections extending from the upper portion of the handle, a plurality of mating projections extending from the base, an elastic compression member and a fastener, the elastic compression member being displaceable about axis A-A, and the fastener and the elastic member exerting a force along axis A-A during a static condition between the base and the handle and during rotation of the base with respect to the upper portion of the handle to retain the projections of the upper portion of the handle engaged with the projections of the base during the static condition between the base and the handle and during rotation of the base with respect to the upper portion of the handle.

2. The multi-adjustable paint applicator assembly of claim 1, wherein the second adjustment assembly is actuated by exerting a rotation force on one of the base and the handle, while retaining the other of the base and the handle in a fixed position.

3. The multi-adjustable paint applicator assembly of claim 1, wherein the projections of the second adjustment assembly comprise ribs extending from the base that slidingly contact mating ribs extending from the upper portion of the handle during rotation of the base with respect to the upper portion of the handle.

4. The multi-adjustable paint applicator assembly of claim 1, wherein the second adjustment assembly is adapted to allow for rotation of the base 360° with respect to the handle.

5. The multi-adjustable paint applicator assembly of claim 1, wherein the elastic compression member is an elastomeric washer.

6. The multi-adjustable paint applicator assembly of claim 1, wherein the fastener, the elastic compression member, the projections extending from the upper portion of the handle and projections and the projections extending from the base are internal to the handle and body of the multi-adjustable paint applicator assembly.

7. The multi-adjustable paint applicator assembly of claim 1, further comprising a removable paint applicator connected to the base, wherein the spring force of the elastic compression member is adjustable, and wherein the paint applicator must be removed to adjust the fastener and thereby change spring force exerted by the elastic compression member.

8. The multi-adjustable paint applicator assembly of claim 1, further comprising a receiver in the base and a paint applicator having an engaging member that mates with the receiver to removably secure the paint applicator to the base.

9. The multi-adjustable paint applicator of claim 8, wherein the receiver comprises an inwardly directed cavity, and wherein the engaging member comprises a projection that is slidingly received by the receiver to removably connect the paint applicator to the elongated handle.

10. The multi-adjustable paint applicator assembly of claim 1, further comprising a finger pivotally connected to the handle, the finger pivoting from a first position in line with a longitudinal axis of the handle to a second position at an angle to the axis of the handle.

11. The multi-adjustable paint applicator assembly of claim 1, wherein the first adjustment assembly comprises a first array of mating members, a mating second array of mating members, a tension fastener having an adjustment member, the tension fastener connecting the first and second array of mating members, and the elastic compression member in association with the tension fastener, and wherein the tension between the first array of mating members and the second array of mating members can be adjusted by adjusting the tension fastener.

12. The multi-positioned paint applicator assembly of claim 11, wherein the mating members comprise ribs.

13. A multi-adjustable paint applicator assembly comprising:

an elongated handle having a longitudinal axis A-A, a base having a receiver, the base being rotatably connected to the handle with an adjustment assembly comprising a plurality of projections extending from the handle, a plurality of mating projections extending from the base, an elastic compression member and a fastener, the elastic compression member being displaceable about axis A-A, and the fastener and the elastomeric compression member exerting a force along axis A-A during a static condition between the base and the handle and during rotation of the base with respect to the handle to retain the projections of the handle engaged with the projections of the base during the static condition between the base and the handle and during rotation of the base with respect to the handle, and an engaging member in the base adapted to removably press-fit connect a paint applicator to the base.

14. The multi-adjustable paint applicator assembly of claim 13, wherein the adjustment mechanism is a rotational adjustment mechanism to rotate the base about a longitudinal axis of the handle.

15. The multi-adjustable paint applicator assembly of claim 13, wherein the adjustment mechanism comprises a fastener and a first arrangement of ribs that intermesh with a second arrangement of ribs, and wherein the fastener provides tension between the first and second rib arrangements to releasably secure mating ribs.

16. A multi-adjustable paint applicator assembly comprising: an elongated handle having a lower portion, an upper portion and a longitudinal axis A-A extending about a length of the handle, and a base rotatably connected to the upper portion of the handle by an adjustment assembly, wherein the adjustment assembly provides rotational movement of the base with respect to the handle, the adjustment assembly comprising a plurality of handle mating members, a plurality of base mating members that mate with the handle mating members, an elastic compression member and a fastener, the elastic compression member being displaceable about axis A-A, and the fastener and the elastomeric compression member exerting a force along axis A-A during a static condition between the base and the handle and during rotation of the base with respect to the upper portion of the handle to retain the handle mating members engaged with the base mating members during the static condition between the base and the handle and during rotation of the base with respect to the upper portion of the handle.

* * * * *